United States Patent [19]

Hofsäss

[11] 4,117,443

[45] Sep. 26, 1978

[54] ELECTRIC TEMPERATURE PROTECTION SWITCH

[76] Inventor: Peter Hofsäss, Strietweg 45, D-7530 Pforzheim, Fed. Rep. of Germany

[21] Appl. No.: 803,841

[22] Filed: Jun. 6, 1977

[30] Foreign Application Priority Data

Jun. 4, 1976 [DE] Fed. Rep. of Germany ..... 2625120

[51] Int. Cl.[2] ..... H01H 37/70

[52] U.S. Cl. ..... 337/348; 337/367; 337/371

[58] Field of Search ..... 357/89, 91, 346, 347, 357/348, 365, 367, 370, 371, 380, 349

[56] References Cited

U.S. PATENT DOCUMENTS

| | | | |
|---|---|---|---|
| 3,355,563 | 11/1967 | Ruckriegel | 337/349 X |
| 3,720,899 | 3/1973 | Hire et al. | 337/348 |
| 3,878,499 | 4/1975 | Concin | 337/380 |
| 3,943,478 | 3/1976 | Place | 337/349 X |
| 4,039,991 | 8/1977 | Bucheister | 337/348 |

*Primary Examiner*—George Harris
*Attorney, Agent, or Firm*—Craig & Antonelli

[57] ABSTRACT

An electric temperature protection switch is provided which has at least two encapsulated contacts in a housing and a current transmission member controlled by a temperature sensing bimetal snap plate. A manual push button device, biased by the force of a reset spring is provided for switching the released switch on again. The switch includes a first bistable snap element directly connected with the transmission member for holding the same in the respective on and off positions. A switch plunger is disposed at a distance from the current transmission member corresponding maximally to the switching stroke of the push button and guided slidably on the switch housing. A second snap element cooperates with the switch plunger and the push button device, which second snap element is moved into a passive position from an active position as the result of actuation of the manual device at critical temperatures, whereby switching of the transmission member from the off to the on position takes place. Greater setting force is provided with respect to the second snap element than with that of the first snap element and a stop is fixed on the housing for the switch plunger for resetting the second snap element from its passive to its active position, with springing back of the spring-loaded push button manual device.

26 Claims, 4 Drawing Figures

ELECTRIC TEMPERATURE PROTECTION SWITCH

Figure 1:
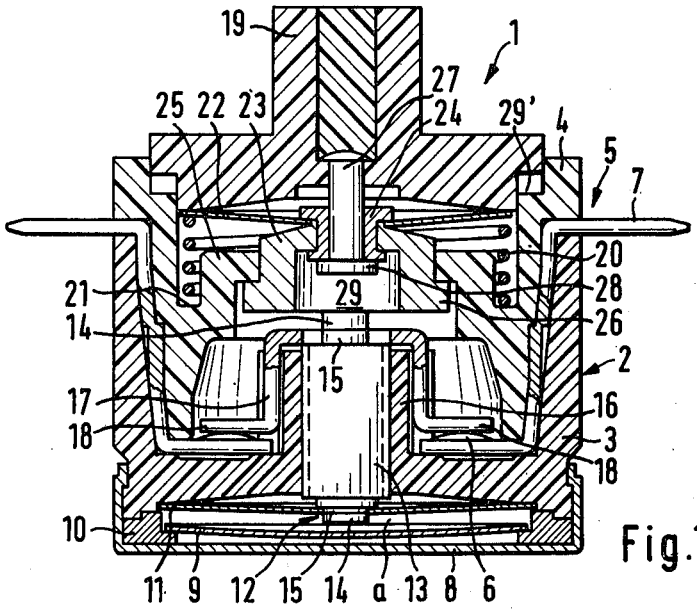

The invention relates to an electric temperature protection switch with at least two encapsulated contacts in a housing and a current transmission member controlled by a temperature sensor, which transmission member, in the on position, is in spring-loaded application against the contacts, and fixed in the off position, and with a manual device that is urged by the force of a reset spring, to switch the disconnected switch on again.

Switches of this described type are known and are incorporated as temperature control switches in appliances in which a specific critical temperature must not be exceeded. The switches can be miniaturized so that they can be utilized in a space-saving way. Most such switches directly control the operating current circuit, e.g. the supply of current to a heating element or the like.

In electric furnaces switches are known that present a movable thrust mechanism with a current transmission member, applied in the on position to contacts within the housing, thereby closing the circuit. To keep the thrust mechanism in the on position, against the spring force that urges it to the off position, there is a shoulder on the thrust mechanism in which a suitably shaped tip of a bimetal strip that serves as temperature sensor engages, which bimetal strip in turn is parallel to the thrust mechanism. If the switch is heated, the bimetal strip bends and moves away from the thrust mechanism so that ultimately the tip comes free of the shoulder on the thrust mechanism, and because of spring force this mechanism moves from the on position into the stable off position. The current transmission member can be restored to the on setting by a manual device that acts on the thrust mechanism.

It is a disadvantage in this switch that with actuation of the manual device for renewed switching on, the circuit is closed at least for the duration of the actuation because the device acts directly on the current transmission member. Thus it may happen that the switch will be moved into the on position as a consequence of actuation of the manual device, although the temperature sensor is still in the critical temperature range, hence practically speaking in the off position. Consequently the switch will be brought with actuation of the manual device into the on setting at the wrong time, so that at least briefly the protective function for which the switch is actually intended will be eliminated.

This known switch, like all other known electric temperature protection switches, has the disadvantage that it is not secured against untimely switching on, if the manual device is actuated before or during the release of the temperature protective switch. This can occur unintentionally for example in the case of a temperature protection switch incorporated in a cable drum, if the cable drum falls over and the manual device disposed at the side comes into contact with the floor, so that it is continuously actuated because of the intrinsic weight of the cable drum. If in this case the switch is tripped because of excessive temperatures, it is not fixed in the off position but will automatically return to the on position at non critical temperatures.

There has been an insistent demand for this reason, further to increase the safety of temperature protection switches, for a new switch where with continuously actuated manual device and after its release at critical temperatures it will remain in the off position if the temperature again drops to non critical values. For switching on again there must be a renewed actuation of the switch. Although for a long time there has been a serious need for a temperature protection switch presenting these characteristics which have "manual tripping", and many efforts have been made to produce such a switch, this problem has not yet been solved technically in temperature protection switches, particularly those of small dimensions.

Therefore the problem to which the invention is addressed is the production of a temperature protection switch of the described construction, with manual tripping.

This problem is solved according to the invention by a first snap element positively coupled with the current transmission member and holding said member in the switched on or switched off position, a switch plunger slidably guided on the housing at a distance from the current transmission member that corresponds maximally to the switching stroke of the manual device, a second snap element cooperating with the switch plunger and the manual device, moved into a passive position as the result of actuation of the said manual device at critical temperatures, from an active position for switching on the current transmission member which is in the switched off position, said second snap element having a setting force that is greater with reference to that of the first, and a stop fixed on the housing for the switch plunger, for switching back the second snap element from the passive into the active position with springing back of the spring-loaded manual device. According to a preferred embodiment, the temperature sensor is a bimetal snap plate and the snap elements are spring snap plates.

The first spring snap plate is connected with the current transmission member in positive force or form engagement, and holds the said member in both off and on positions, in which latter position it also applies the contact pressure. When the manual device is not actuated and the current transmission member is in the on position, the bimetal snap plate, with transition from non critical to critical temperatures, moves the current transmission member into the off position in which it is held. If thereafter, with still critical temperatures, i.e. with snapped bimetal snap plate, the manual device is actuated, this acts on the current transmission member via the second spring snap plate and the switch plunger. Since this current transmission member is held in the off position both by the bimetal snap plate and by the first spring snap plate, whose two setting forces together are greater than that of the second spring snap plate, it is not moved by the spring force of the second snap plate into the on position. Rather, with actuation of the manual device and switched off current transmission member, the second spring snap plate itself is switched from the active to the passive position in which it does not act on the current transmission member. With release of the manual device this member moves, because of the force of the reset spring, back into its starting position and carries along the second spring plate that cooperates with it. During the backward movement of the spring snap plate, this strikes against the stop that is fixed on the housing before the starting position of the manual device so that it is again switched from the passive to the active position. Thus the electric temperature protection switch cannot be switched on while temperatures are still critical. If the temperature protection switch cools down to non critical temperatures and the bimetal snap plate jumps again, it can be brought into the on position with actuation of the manual device because then the force of the second spring snap plate acting on the current transmission member will be sufficient to switch the first spring snap plate and therewith the current transmission member into the on position.

Depending upon the distance of the switch plunger of the current transmission member with reference to the switch stroke of the manual device, the second spring snap plate will be switched over from the active to the passive position not only with the current transmission member in the off position but also with any actuation of the manual device. In particular, the switch plunger thereby comes into application on the current transmission member which is in the on position, whereby the second spring snap plate will be switched over from the active to the passive position.

If the temperature protection switch is on and the manual device is actuated, then the bimetal snap plate will switch the first spring snap plate during the snap process and thus switch the current transmission member and the temperature protection switch into the off position. Here it does not matter if the second spring snap plate is already in the passive position or still in the active position. The temperature protection switch thus is released in spite of the actuation of the manual device at critical temperatures, and is held in the off position by the first spring snap plate. At non critical temperatures it can only be switched on if the previously actuated manual device is released, whereby the second spring snap plate is switched over from the passive to the active position because of the stop fixed on the housing. Only if the switch is then depressed again will the second spring snap plate act on the current transmission member via the switch plunger because of its active position, and act on the first spring snap plate with less setting force than the second, whereby this member will be switched into the on position.

With the electric temperature protection switch with manual tripping according to the invention, there is thus the advantage that in spite of unintentional actuation of the manual device at critical temperatures it will be switched into the off position and held there, even if the temperature again moves down into the non critical range.

Accordig to a preferred embodiment of the invention, the first spring snap plate is fixed with its center to one end of a plunger that is guided on the housing, at the other end of which plunger the current transmission member is fixed. It is also possible however to control the current transmission member via the periphery of the spring snap plate, which then must bear with its center on two backup surfaces fixed on the housing. Advantageously the first spring snap plate and the current transmission member each present a central hole engaged positively in form or force by the free end of the plunger. To simplify the assembling of the temperature protection switch, the plunger is advantageously cylindrical with terminal parallel flattened surfaces that present constrictions, and the holes in the current transmission member and the first spring snap plate are adapted to the cross section configuration of the flattened portion. Thus the plunger can be inserted in the hole of the current transmission member and then by turning the plunger, it can be applied firmly against the current transmission member. The plunger is then inserted through the hollow piece and at its other side it is also inserted into the first spring snap plate and then turned by a specific angle, advantageously 90°, whereby both parts are positively applied against the ends of the plunger.

Other advantageous embodiments of the invention are characterized elsewhere in this application, including the claims.

If the setting force of the helical spring for resetting the manual device which is made as a push button is greater than that of the second spring snap plate, the push button will always move automatically back into its initial position because of the force of the reset spring when it is released. If however it is less than the setting force of the second spring snap plate, when the manual device is released it will not be switched back from its passive to its active position by the stop fixed on the housing. For this it will be necessary to depress the push button manually, over the dead point position of the second spring snap plate.

According to a preferred form of embodiment, the temperature protection switch is made as an opener switch, but it may also be made as a closing switch, for incorporation in various devices. The later, in contrast to the opener, will close a circuit, e.g. an auxiliary circuit, at critical temperatures.

Other features, details and advantages of the invention will become evident from the following description of a preferred embodiment of the invention which is shown in the drawing.

Figure 4:
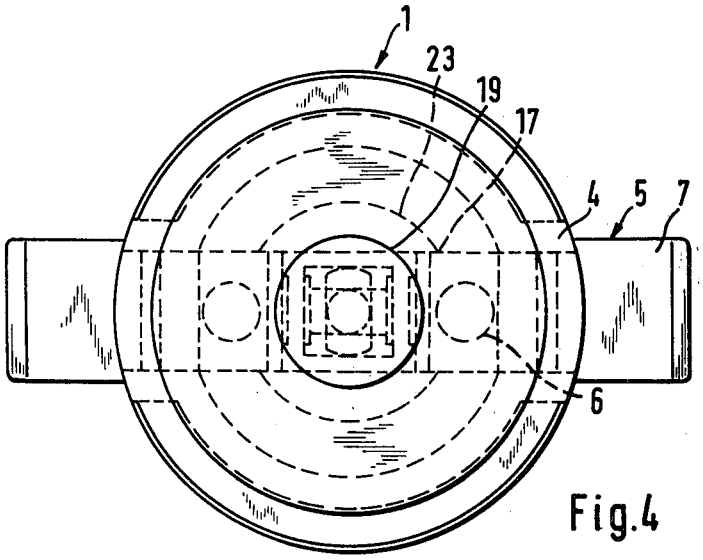
Figure 2:
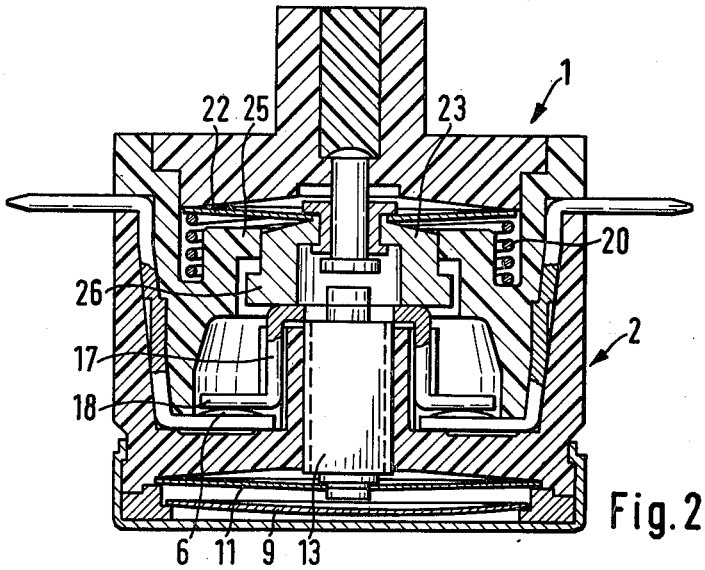
Figure 3:
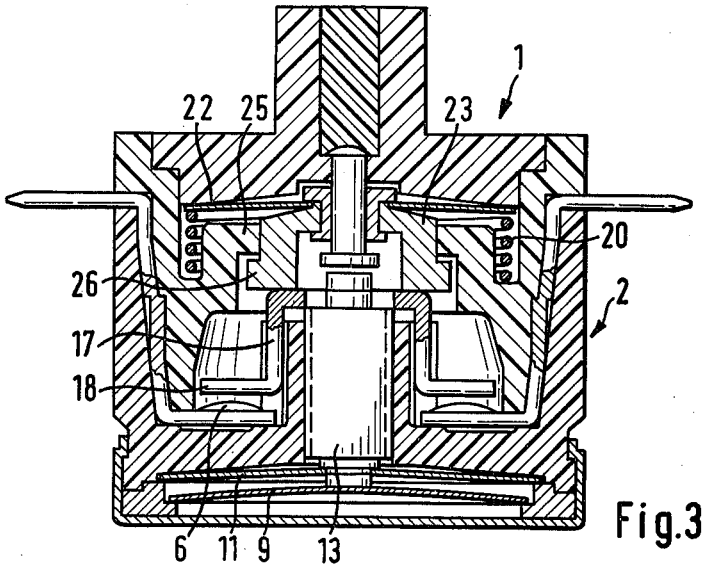

FIG. 1 shows the electric temperature protection switch in the on position with manual device not actuated, in schematic cross section FIG. 2 shows the electric temperature protection switch in the on position with manual device actuated, in schematic cross section FIG. 3 shows the electric temperature protection switch in the off position with manual device actuated, in schematic cross section FIG. 4 shows a top view of the temperature protection switch.

The temperature protection switch which is designated by numeral 1 as a whole presents a housing 2 with a lower part 3 and an upper part 4, between which current conductors 5 is taken into the interior of the housing. The conductors 5 present connecting contacts 6 at their ends inside the housing, and at the opposite ends there are plug connectors 7.

In a space *a* formed by a closure cap 8 as floor of the housing and lower part 3 of the housing there is a bimetal snap plate 9 bearing peripherally on the housing and freely movable. Over this there is a first spring snap plate 11 which is clamped against turning, peripherally with its edge, between lower part 3 of the housing and a circular housing edge piece 10. The first spring snap plate 11 has a central hole 12 through which a plunger 13 penetrates, furnished at its ends with two respectively parallel flattened surfaces 14 with constrictions 15 in this zone, whereby the flattened surface penetrates the hole in the first spring snap plate 11 which is adapted to its cross section and then by turning is firmly applied to plunger 13.

Plunger 13 is guided on the inner wall of a hollow piece 16 inside the housing and at its end that is opposite spring snap plate 11 it is similarly applied to a U-shaped current transmission member 17. The said member presents arm ends 18 that are bent outward at a right angle, being applied to contacts 6 of current conductor 5. The current transmission member 17 is guided with its mutually opposing inner sides on housing piece 16.

On the upper side of the housing there is a manual device made as a push button 19, peripherally guided on the housing. Push button 19 is biased by the force of a reset spring that is made as a helical spring 20 that bears on its backup surface 21 on the housing side. Between helical spring 20 and push button 19 there is a second spring snap plate 22 fixed with its peripheral edge, with its central hole, on a guide sleeve 24 that in turn is slidably guided on a switch plunger 23.

Switch plunger 23 is peripherally disposed on a housing shoulder 25 so as to be longitudinally movable, and on its under side it presents a collar 26 applied to housing shoulder 25, which collar acts as a stop for the stroke motion of the switch plunger. In guide sleeve 24 there is a guide pin 27 fixed to push button 19, which guide pin has a limiting stop 28 and thus fixes push button 19 in its initial position. The switch plunger, on the side turned toward the current transmission member 17, has a recess 29 which overlaps the flattened surface 14 projecting over the current transmission member. The flat lower remaining edge of recess 29, in actuation of push button 19, bears on the crosspiece of the U-shaped current transmission member 17. The upper side of switch plunger 23 is in the form of a truncated cone, just as the underside of push button 19 presents an inwardly directed truncated conical underside. There is also a recess therein for the part of guide sleeve 24 that projects above switch plunger 23. Because of the two truncated conical surfaces, the second spring snap plate 22 can be switched from the active position shown in FIG. 1 to the passive position according to FIG. 3, whereby its edge in both positions in always tensioned between the push button 19 and the spring 20.

The switching stroke of push button 19 is determined by the starting position as determined by the distance between stop 26 on housing shoulder 25 of switch plunger 23 and the limiting stop 28 on guide sleeve 24 and its distance in this position from the circular bearing surface 29' on the upper part 4 of the housing. The switching stroke of push button 19 is at least as great as the distance between the switch plunger with unactuated push button and the current transmission member 17.

If the electric temperature protection switch is brought, in the position of FIG. 1, to critical temperatures, bimetal snap plate 9 bends and by snapping acts on plunger 13 which in turn lifts current transmission member 17 from contacts 6 and interrupts the circuit. By the first spring snap plate 11 that is directly coupled with plunger 13, the plunger will be switched over into the off position as shown in FIG. 3. Both positions of the first spring snap plate 11 (FIGS. 1, 3) are stable, and therefore the current transmission member will be held in both the on and off positions.

If in the off position, push button 19 is actuated (FIG. 3), then the second spring snap plate 22 whose setting force is of course greater than that of the first spring snap plate 11 cannot switch it over into the on position, because the two setting forces of the first spring snap plate and snapped bimetal snap plate together are greater than that of second snap spring plate 22, so that the current transmission member is held in the initial position as shown in FIG. 3. Rather, the second spring snap plate is thereby itself switched from the active position shown in FIGS. 1 and 2, to the passive position of FIG. 3.

Only after release, i.e. with manual device not actuated, can the current transmission member be again brought into the on position of FIG. 2, when there is not critical temperature and the bimetal snap plate is snapped to on, by the actuation of push button 19.

It is immaterial for the inventive principle of the temperature protection switch, whether with actuation of the push button and with temperature protection switch in the on position, the second snap plate 22 which acts on current transmission member 17 via switch plunger 23 is in the active position of FIGS. 1 and 2, or switched over into the passive position. In switching into the passive position with any actuation of the push button, the second spring snap plate will automatically be switched back into the active position upon release of the push button, via stop 26 which is fixed on the housing of switch plunger 23. For switching over from the active to the passive position in any actuation of the manual device it is only necessary to have the depression depth of the push button somewhat greater than in the example of embodiment as illustrated.

To make the switch as a closing switch, it is only necessary to make the conductor shorter so that it will be disposed above the bent down ends of the arms of the current transmission member. The contacts then must be disposed on the underside of the current conductor. The on position of this closing switch then corresponds to the off position of the opening switch, and vice versa.

I claim:

1. Electric temperature protection switch with at least two encapsulated contacts in a housing and a current transmission member controlled by a temperature sensor, which transmission member in the on position is in spring-loaded application on the contacts, and is fixed in the off position, and with a manual device biased by the force of a reset spring for switching on the released switch again; said switch comprising:

a first distance snap element directly connected with the current transmission member for holding the current transmission member in its respective off and on positions, a switch plunger disposed at a distance from the current transmission member corresponding maximally to the switching stroke of the manual device and guided slidably on the housing, a second snap element cooperating with the switch plunger and the manual device which is moved into a passive position from an active position as the result of actuation of the said manual device at critical temperatures, for switching on the current transmission member that is in the off position, with greater setting force with respect to that of the first snap element, and a stop fixed on the housing for the switch plunger for resetting the second snap element from the passive to the active position, with springing back of the spring-loaded manual device.

2. Temperature protection switch according to claim 1, characterized in that the temperature sensor is a bimetal snap plate and the snap elements are spring snap plates.

3. Temperature protection switch according to claim 1, characterized in that the first spring snap plate is firmly applied with its center on one end of a plunger guided on the housing, on the other end of which plunger the current transmission member is fixed.

4. Temperature protection switch according to claim 2, characterized in that the first spring snap plate is firmly applied with its center on one end of a plunger guided on the housing, on the other end of which plunger the current transmission member is fixed.

5. Temperature protection switch according to claim 4, characterized in that the first spring snap plate and the current transmission member respectively present a central hole positively engaged as to form or force by the opposing end of the plunger.

6. Temperature protection switch according to claim 5, characterized in that the plunger is cylindrical, with flattened surfaces at its ends, parallel to each other, with constrictions, and in that the holes in the current transmission member and the first spring snap plate are adapted to the cross section configuration of the flattened surfaces.

7. Temperature protection switch according to claim 6, characterized in that the first spring snap plate and the current transmission member are fixed against rotation on the housing.

8. Temperature protection switch according to claim 7, characterized in that the current transmission member is made as a U-shaped arcuate member with arm ends bent at a right angle and applied against the contacts, and guided so as to be fixed against rotation on a piece inside the housing.

9. Temperature protection switch according to claim 8, characterized in that the second spring snap plate cooperates with the manual device via an edge that is applied to a side of the said manual device.

10. Temperature protection switch according to claim 3, characterized in that the second spring snap plate cooperates with the manual device via an edge that is applied to a side of the said manual device.

11. Temperature protection switch according to claim 9, characterized in that the manual device is spring loaded by a helical spring bearing on a backup surface on the side of the housing, and applied to the other side of the edge of the second spring snap plate.

12. Temperature protection switch according to claim 9, characterized in that the second spring snap plate presents a central recess in which the switch plunger which is slidably guided on housing shoulders is firmly applied.

13. Temperature protection switch according to claim 11, characterized in that the second spring snap plate presents a central recess in which the switch plunger which is slidably guided on housing shoulders is firmly applied.

14. Temperature protection switch according to claim 12, characterized in that the manual device is a push button slidably guided peripherally on the housing and on the switch plunger.

15. Temperature protection switch according to claim 13, characterized in that the manual device is a push button slidably guided peripherally on the housing and on the switch plunger.

16. Temperature protection switch according to claim 14, characterized in that the switch plunger presents a guide sleeve on which a guide pin fixed on the push button is guided.

17. Temperature protection switch according to claim 15, characterized in that the switch plunger presents a guide sleeve on which a guide pin fixed on the push button is guided.

18. Temperature protection switch according to claim 16, characterized in that the guide pin presents a limiting stop on its free end for the push button which bears on one of the switch plunger and the guide sleeve.

19. Temperature protection switch according to claim 17, characterized in that the guide pin presents a limiting stop on its free end for the push button which bears on one of the switch plunger and the guide sleeve.

20. Temperature protection switch according to claim 12, characterized in that the switch plunger has a collar on the side turned toward the current transmission member which is applied to a housing shoulder and constitutes the stop for the second spring snap plate.

21. Temperature protection switch according to claim 14, characterized in that the switch plunger has a collar on the side turned toward the current transmission member which is applied to a housing shoulder and constitutes the stop for the second spring snap plate.

22. Temperature protection switch according to claim 18, characterized in that the switch plunger has a collar on the side turned toward the current transmission member which is applied to a housing shoulder and constitutes the stop for the second spring snap plate.

23. Temperature protection switch according to claim 14, characterized in that the switch plunger has a truncated conical upper side and the push button has an inwardly directed truncated conical underside.

24. Temperature protection switch according to claim 16, characterized in that the switch plunger has a truncated conical upper side and the push button has an inwardly directed truncated conical underside.

25. Temperature protection switch according to claim 11, characterized in that the setting force of the helical spring is greater than that of the second spring snap plate.

26. Temperature protection switch according to claim 13, characterized in that the setting force of the helical spring is greater than that of the second spring snap plate.

* * * * *